US009017184B1

(12) United States Patent
Johnson

(10) Patent No.: US 9,017,184 B1
(45) Date of Patent: Apr. 28, 2015

(54) TRAINING GOLF BALL

(71) Applicant: Arnold Johnson, Ontario (CA)

(72) Inventor: Arnold Johnson, Ontario (CA)

( * ) Notice: Subject to any disclaimer, the term of this patent is extended or adjusted under 35 U.S.C. 154(b) by 0 days.

(21) Appl. No.: 14/335,582

(22) Filed: Jul. 18, 2014

(51) Int. Cl.
*A63B 69/36* (2006.01)

(52) U.S. Cl.
CPC ..... *A63B 69/3688* (2013.01)

(58) Field of Classification Search
USPC ..... 473/198, 200, 280, 281
See application file for complete search history.

(56) References Cited

U.S. PATENT DOCUMENTS

| | | | | | |
|---|---|---|---|---|---|
| 3,918,720 | A * | 11/1975 | Gordos | ..... | 473/200 |
| 4,494,757 | A * | 1/1985 | Simjian | ..... | 473/200 |
| 5,885,165 | A * | 3/1999 | Krause | ..... | 473/200 |
| 8,388,463 | B2 * | 3/2013 | Turner et al. | ..... | 473/280 |
| 2009/0203460 | A1 * | 8/2009 | Clark | ..... | 473/236 |

* cited by examiner

*Primary Examiner* — Nini Legesse
(74) *Attorney, Agent, or Firm* — David W. Barman

(57) ABSTRACT

A golf ball is provided that includes a pair of congruous, opposing, spherical hemispheres, each having a hemispheric diameter and a hemispheric planer surface; at least one spacer attached to each hemispheric planer surface; and at least one central disk positioned between each hemispheric planer surface and each spacer, said central disk having a circular planer surface with a diameter of approximately 95-99% of said hemispheric diameter, said central disk having opposing planer surfaces equidistantly positioned offset from each hemispheric planer surface by a distance relative to said hemispheric diameter of about 9.1 and 13.5 percent.

8 Claims, 4 Drawing Sheets

TRAINING GOLF BALL

BACKGROUND OF THE INVENTION

Golf enthusiasts are consistently looking for articles and devices to improve their game. One area of the game that is constantly undergoing training and attention is the skill of putting. While there are numerous advancements in construction and technology of the putter, very little attention has been focused on the ball. The invention described herein provides a novel ball for use in training of putting skill.

SUMMARY OF THE INVENTION

As generally understood in the present invention, contemplated use includes:

(1) One key element of good putting is to have your eyes directly over the intended line of putt. The Center Disk addresses this during setup. A user perceives right away while looking down that they are either inside, outside or directly above the disk.

(2) Alignment: Because a user has two channels to look at during setup, it's clear as to whether the ball is aimed at your intended Line.

(3) Square Club face on impact: If a strike is made on the ball and it's not square enough to strike both edges at the same time, the ball will roll off line. Example: Right handed putter, if the toe comes in contact, first the ball will start going to the left with a wobble. If the heel strikes first, the ball will go right with a wobble. Once a pure strike is made on the ball with both edges being strike at the same time, the ball will stay on line and roll true (i.e. straight).

In one embodiment, the present invention is a golf ball comprising:

a pair of congruous, opposing, spherical hemispheres, each having a hemispheric diameter and a hemispheric planer surface;

at least one spacer attached to each hemispheric planer surface;

at least one central disk positioned between each hemispheric planer surface and each spacer, said central disk having a circular planer surface with a diameter of approximately 95-99% of said hemispheric diameter, said central disk having opposing planer surfaces equidistantly positioned offset from each hemispheric planer surface by a distance relative to said hemispheric diameter of about 9.1 and 13.5 percent.

In one embodiment, each spherical hemisphere is sized equivalent to a conventional golf ball.

Each spacer is permanently attached to a single respective hemisphere. In one embodiment, each spacer is permanently attached to a single respective hemisphere with an adhesive.

In one embodiment, each spacer is circular and positioned on a common radial axis with each hemisphere.

In one embodiment, said central disk is positioned on a common radial axis with each hemisphere.

In one embodiment, the central disk has a ratio of diameter: thickness of about 1:0.03-0.05.

In one embodiment, the spacer has a ratio of diameter: thickness of about 1:0.40-0.55.

DETAILED DESCRIPTION OF THE PREFERRED EMBODIMENT

Figure 1:
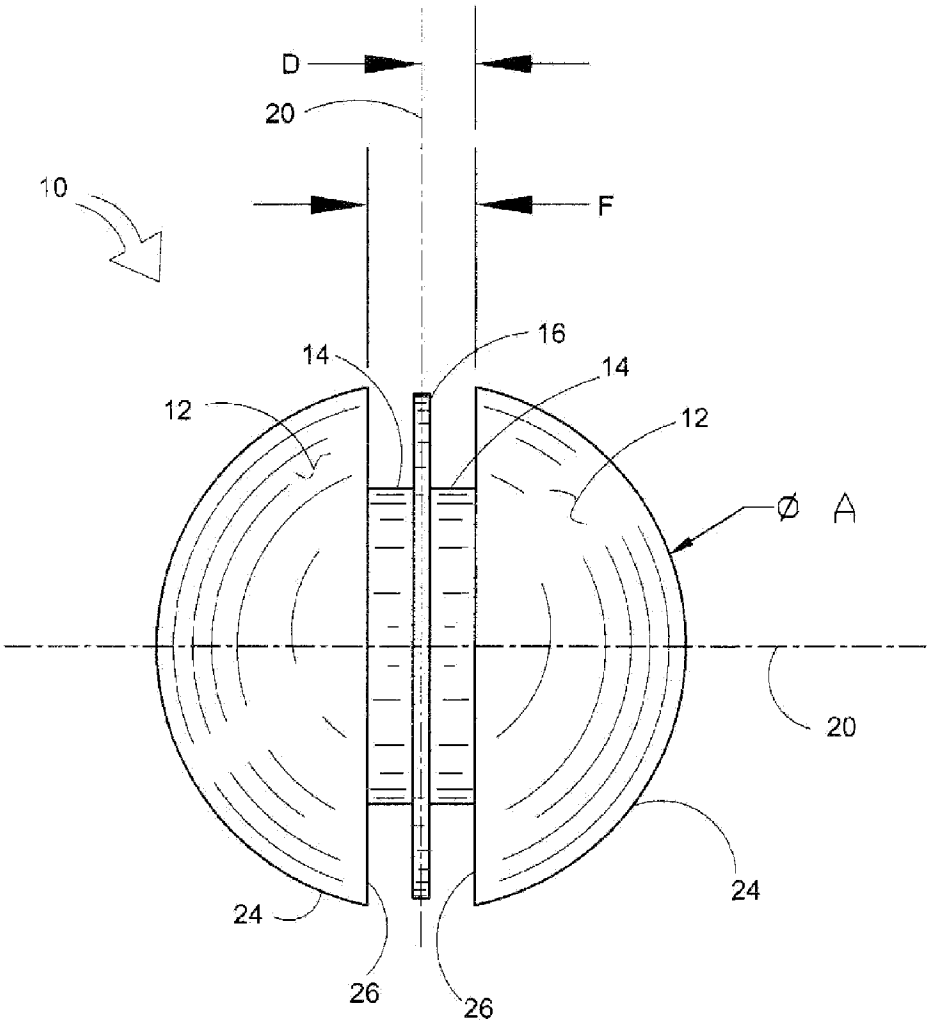
FIG. 1 is a top view of the ball of the present invention.
Figure 2:
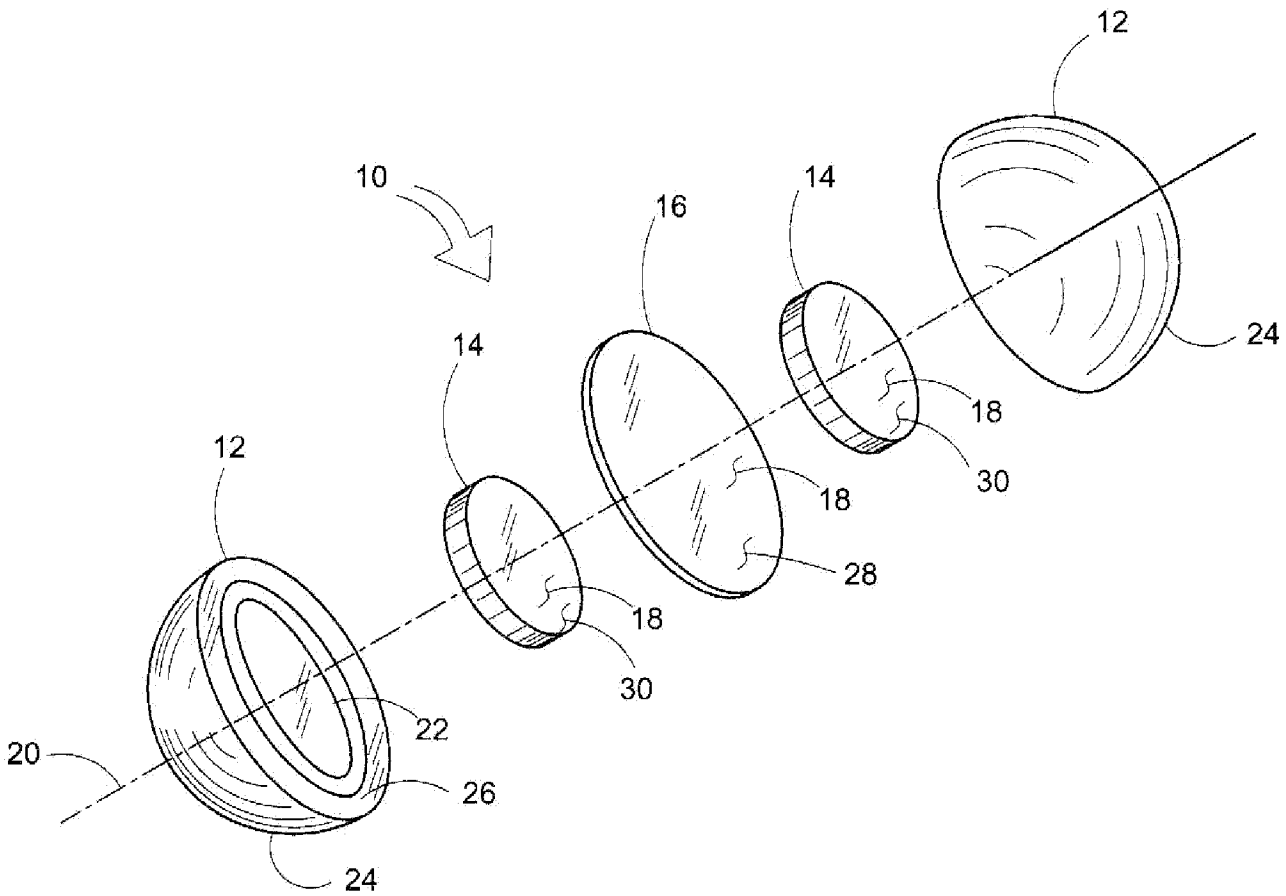
FIG. 2 is an exploded isometric view of the ball of the present invention.
Figures 3, 4, 5, 6, 7, 8:
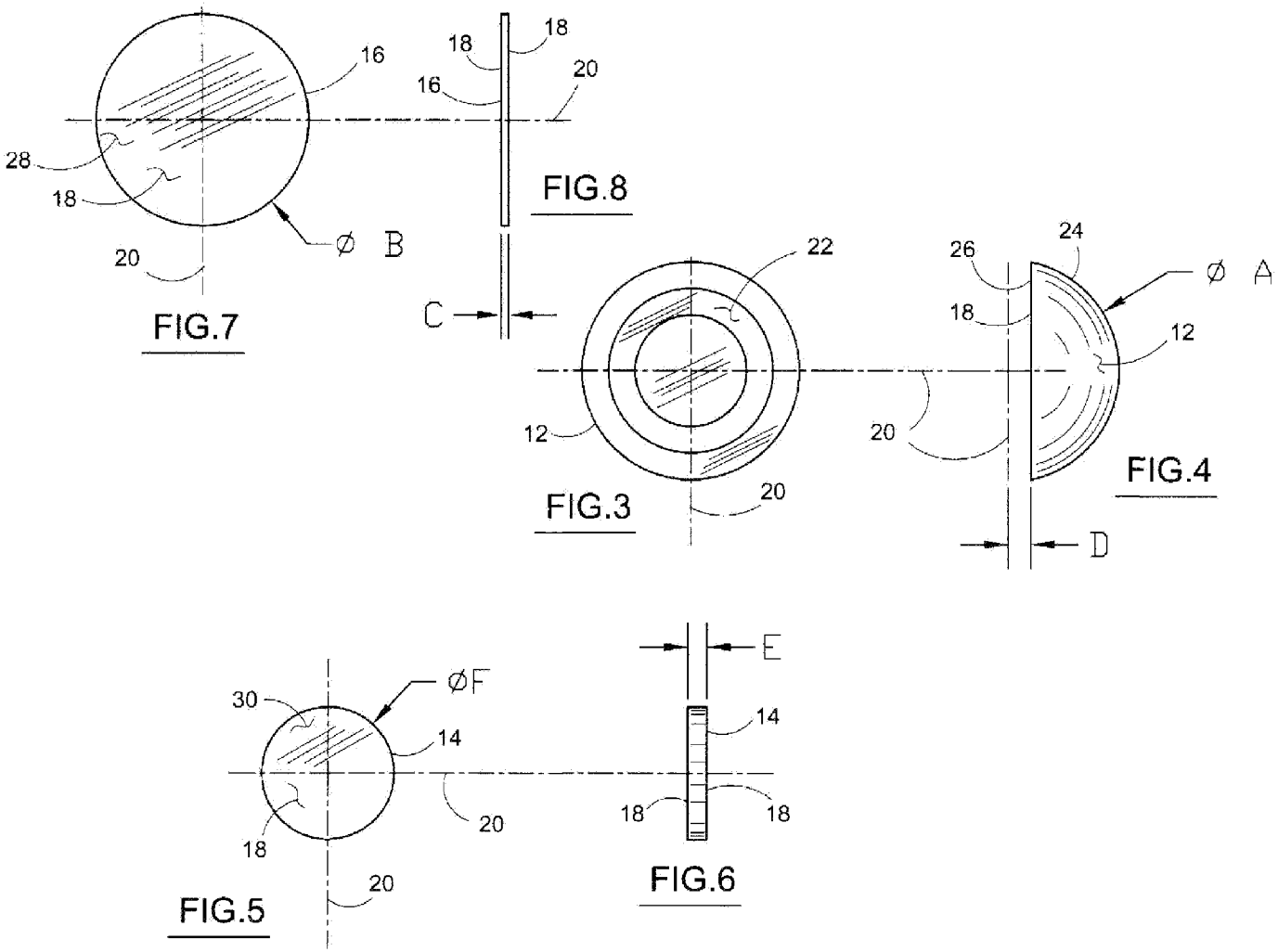
FIG. 3 is a front view of one hemisphere of the ball of the present invention.
FIG. 4 is a side view of one hemisphere of the ball of the present invention.
FIG. 5 is a front view of a spacer core to the present invention.
FIG. 6 is a side view of a space according to the present invention.
FIG. 7 is a front view of a disk according to the present invention.
FIG. 8 is a side view of a disk according to the present invention.

The present invention is a golf ball constructed and arranged in order to improve skill in the golf area of putting. Ball 10 includes a pair of opposing identical hemispheres 12 each having opposing identical spacers 14 that contact a central disc 16 on opposing central disk planer surfaces 26. In one embodiment, each planar surface 30 of the spacer 14 has an adhesive 18 disposed thereon for securing disk 16 on one hemisphere planar surface 28 on hemisphere 12 and on the opposite planar surface to disk 16. Construction of ball 10 includes positioning each hemisphere precisely in relation to disk 16. Central axis 20 relates to a horizontal hemispheric access and the present invention requires each hemisphere 12 spacer 14 and the central disc 16 to have a geometric center congruous with axis 20. Dimension A generally refers to the outside diameter of a golf ball. Although a standard golf ball has a diameter 1.680 inches (42.67 mm), the present invention contemplates Dimension A is either a standard size golf ball or other sized ball utilized for practice and training. Dimension B is the diameter of disk 16. In one embodiment, Dimension B is approximately between 94-99.5 percent the diameter of Dimension A. In another embodiment, Dimension B is approximately between 95.0-99.0 percent the diameter of Dimension A. In one embodiment, Dimension A is a standard golf ball diameter 1.680 inches and Dimension B has a diameter of 1.600 inches. As can be seen by these requirements, it is contemplated that the diameter of disk 16 be less than the diameter of either of the hemispheres 12. Additionally, it is contemplated that each planar surface of hemisphere 12, spacer 14, and disk 16 are congruent, parallel to one another, and form a perpendicular with axis 20. The perpendicular orientation is important, as a failure to construct the ball of the present invention in the parallel and perpendicular configurations described will result in a ball that does not roll properly when struck.

In a preferred embodiment, Dimension C, the thickness of disk 16 is between about 2.5 and 5.9 percent of Dimension A (ball diameter). In another embodiment, Dimension C is between about 3.0-4.9 percent of Dimension A. In one embodiment, Dimension A is a standard golf ball diameter 1.680 inches and Dimension C has a size of about 0.52 inches.

In a preferred embodiment, Dimension D, the distance from the planer surface of hemisphere 12 to planer surface of disk 16 is between about 9.1 and 13.5 percent of Dimension A (ball diameter). In another embodiment, Dimension D is between about 9.9-13.5 percent of Dimension A. In another embodiment, Dimension D is between about 9.9-11.9 percent of Dimension A. In one embodiment, Dimension A is a standard golf ball diameter 1.680 inches and Dimension D has a size of about 0.171 inches.

In a preferred embodiment, Dimension E, the distance defining the thickness of space 14 is between about 7.1 and 12.5 percent of Dimension A (ball diameter). In another embodiment, Dimension E is between about 8.1-11.9 percent of Dimension A. In another embodiment, Dimension E is between about 8.5-11.9 percent of Dimension A. In one embodiment, Dimension A is a standard golf ball diameter 1.680 inches and Dimension E has a size of about 0.145 inches.

In a preferred embodiment, Dimension F, the distance between each planer surface of hemisphere 12 is between about 16.5 and 24.5 percent of Dimension A (ball diameter). In another embodiment, Dimension E is between about 18.1-23.5 percent of Dimension A. In another embodiment, Dimension F is between about 19.5-23.5 percent of Dimension A. In one embodiment, Dimension A is a standard golf ball diameter 1.680 inches and Dimension F has a size of about 0.342 inches.

In one embodiment the ratio of Dimension A:Dimension B:Dimension C is about 1:0.9-0.99:0.025-0.059.

In one embodiment the ratio of Dimension B:Dimension C (diameter to thickness of disk 16) is about 1:0.03-0.05.

In one embodiment the ratio of Dimension F:Dimension E (diameter to thickness of spacer 14) is about 1:0.40-0.55.

In use, a ball is constructed and arranged as described herein. Ball 10 is placed on a surface and a user strikes the ball with a putter such that the putter is parallel to axis 20.

The ball is observed and if not putted straight, the degree of offset is observed by visual indication whereby disk 16 is viewed as oscillating.

Figure 9:
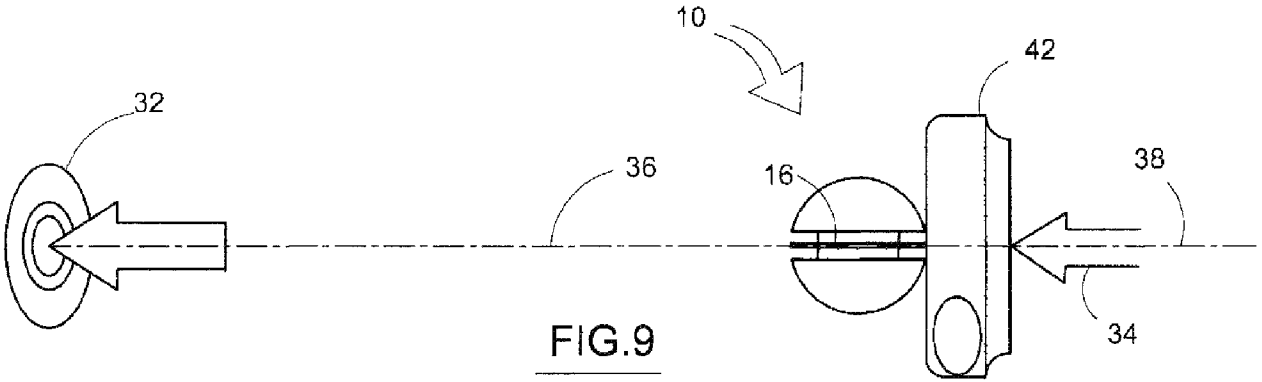
FIG. 9 is demonstrative of the path when a golf ball of the present invention is struck perpendicular to a central axis.

As demonstrated by way of example in FIG. 9, vector line of force 34 is applied along center line 38 and directs ball 10 along line of reaction 36 at target 32. When force is applied, as in with a putter 42, and the putter 42 is precisely perpendicular to centerline 38, ball 10 travels in a straight line along line 36.

Figure 10:
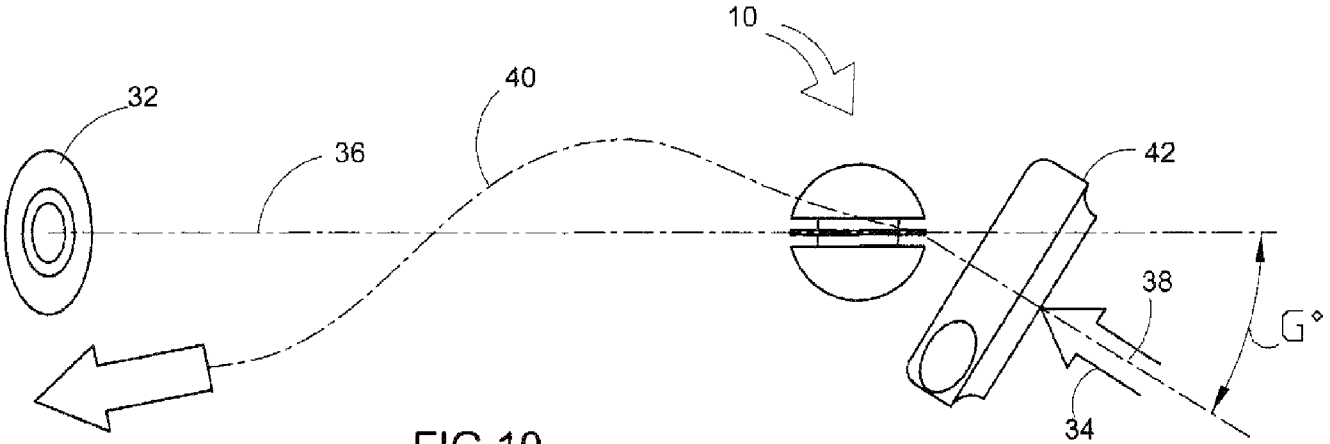
FIG. 10 is demonstrative of one embodiment the path when a golf ball of the present invention is not struck perpendicular to a central axis.

As demonstrated in FIG. 10, vector line of force 34 is applied and directs ball 10 towards an intended target 32. However, when force is applied, as in with a putter 42, and the putter 42 is not precisely perpendicular to centerline 38, but is applied with some type of angular offset of applied force (Angle G) ball 10 does not travel in a straight line along line 36. Ball 10 travels either to one side or another away from the desired centerline 38 and, depending on the amount and direction of applied force 34, ball 10 can oscillate or wobble when struck.

The contemplated pedagogic tool of the invention is to view the center disk 16 rotate as ball 10 moves along line 36 towards target 32 when proper direction of force 34 is applied.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

I claim:

1. A golf ball comprising:

a pair of congruous, opposing, spherical hemispheres, each having a hemispheric diameter and a hemispheric planer surface;

at least one spacer attached to each hemispheric planer surface;

at least one central disk positioned between each hemispheric planer surface and each spacer, said central disk having a circular planer surface with a diameter of approximately 95-99% of said hemispheric diameter, said central disk having opposing planer surfaces equidistantly positioned offset from each hemispheric planer surface by a distance relative to said hemispheric diameter of about 9.1 and 13.5 percent.

2. The ball of claim 1, wherein each spherical hemisphere is sized equivalent to a conventional golf ball.

3. The ball of claim 1, wherein each spacer is permanently attached to a single respective hemisphere.

4. The ball of claim 1, wherein each spacer is permanently attached to a single respective hemisphere with an adhesive.

5. The ball of claim 1, wherein each spacer is circular and positioned on a common radial axis with each hemisphere.

6. The ball of claim 1 wherein said central disk is positioned on a common radial axis with each hemisphere.

7. The ball of claim 1 wherein said central disk has a ratio of diameter:thickness of about 1:0.03-0.05.

8. The ball of claim 1 wherein said spacer has a ratio of diameter:thickness of about 1:0.40-0.55.

* * * * *